US007536905B2

(12) United States Patent
Jalali et al.

(10) Patent No.: US 7,536,905 B2
(45) Date of Patent: May 26, 2009

(54) SYSTEM AND METHOD FOR DETERMINING A FLOW PROFILE IN A DEVIATED INJECTION WELL

(75) Inventors: Younes Jalali, Cambridge (GB); Thang Dinh Bui, Kuala Lumpur (MY); Guohua Gao, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 191 days.

(21) Appl. No.: 10/575,029

(22) PCT Filed: Sep. 2, 2004

(86) PCT No.: PCT/IB2004/002877

§ 371 (c)(1),
(2), (4) Date: Dec. 15, 2006

(87) PCT Pub. No.: WO2005/035944

PCT Pub. Date: Apr. 21, 2005

(65) Prior Publication Data

US 2007/0068672 A1 Mar. 29, 2007

Related U.S. Application Data

(60) Provisional application No. 60/510,596, filed on Oct. 10, 2003.

(51) Int. Cl.
*E21B 47/10* (2006.01)

(52) U.S. Cl. ..... 73/152.33; 702/12

(58) Field of Classification Search ..... 73/152.18, 73/152.29, 152.33, 152.37–152.39, 152.54, 73/152.55; 702/6, 12, 13
See application file for complete search history.

(56) References Cited

U.S. PATENT DOCUMENTS

| | | | | |
|---|---|---|---|---|
| 2,739,475 | A * | 3/1956 | Nowak | 73/152.12 |
| 3,709,032 | A * | 1/1973 | Coles et al. | 73/152.13 |
| 3,913,398 | A * | 10/1975 | Curtis | 73/152.33 |
| 4,520,666 | A * | 6/1985 | Coblentz et al. | 73/152.33 |
| 5,085,276 | A * | 2/1992 | Rivas et al. | 166/303 |
| 5,415,037 | A * | 5/1995 | Griston et al. | 73/152.12 |
| 6,618,677 | B1 * | 9/2003 | Brown | 702/13 |
| 6,920,395 | B2 * | 7/2005 | Brown | 702/13 |
| 6,981,549 | B2 * | 1/2006 | Morales et al. | 166/250.1 |
| 7,055,604 | B2 * | 6/2006 | Jee et al. | 166/305.1 |

(Continued)

FOREIGN PATENT DOCUMENTS

GB 2408327 A * 5/2005

OTHER PUBLICATIONS

Fagley et al., "An Improved Simulation for Interpreting Temperature Logs in Water Injection Wells," Oct. 1982, Society of Petroleum Engineers of AIME, pp. 709-718.*

Fialka, B.N., Pyszka, M.H., Chhina, H.S.: 'The Evaluation of Temperature Logging in Thermal', paper SPE 20084, presented at 60th California Regional Meeting, Venture, CA, (Apr. 4-6, 1990).

(Continued)

*Primary Examiner*—John Fitzgerald
(74) *Attorney, Agent, or Firm*—Daryl Robert Wright; James L. Kurka

(57) ABSTRACT

A system and method is provided for determining flow profiles in a deviated well. The system and method utilize temperature measurements and a modeling technique that enable the use of temperature profiles in deriving flow profiles for fluid injected into deviated wells.

32 Claims, 11 Drawing Sheets

U.S. PATENT DOCUMENTS

| | | | | |
|---|---|---|---|---|
| 7,398,680 | B2 * | 7/2008 | Glasbergen et al. | 73/152.12 |
| 2004/0112596 | A1 * | 6/2004 | Williams et al. | 166/250.03 |
| 2004/0129418 | A1 * | 7/2004 | Jee et al. | 166/250.01 |
| 2005/0149264 | A1 * | 7/2005 | Tarvin et al. | 702/6 |
| 2006/0196659 | A1 * | 9/2006 | Jee et al. | 166/250.01 |
| 2006/0243438 | A1 * | 11/2006 | Brown | 166/250.02 |
| 2007/0023186 | A1 * | 2/2007 | Kaminsky et al. | 166/266 |

OTHER PUBLICATIONS

Brown, G., Storer, D., McAllister, K., 'Monitoring Horizontal Producers and Injectors During Cleanup and Production Using Fiber-Optic-Distributed Temperature Measurements', paper SPE 84379, presented at the SPE Annual Technical Conference & Exhibition, Denver, CO (Oct. 5-8, 2003).

* cited by examiner

SYSTEM AND METHOD FOR DETERMINING A FLOW PROFILE IN A DEVIATED INJECTION WELL

CROSS-REFERENCE TO RELATED APPLICATIONS

This application claims priority from U.S. Provisional Application 60/510,596, filed Oct. 10, 2003, which is incorporated herein by reference.

BACKGROUND OF THE INVENTION

1. Field of the Invention

The present invention relates to a system and methodology for determining a flow profile in a well, and particularly to determining a flow profile in a deviated injection well.

2. Description of Related Art

In a variety of wells, various parameters are measured to determine specific well characteristics. For example, temperature logging has been used for profiling the injection rate in vertical wells. Existing methods of analyzing injection profiles are designed for vertical wells where the injection interval is usually small and the time to flush the wellbore volume is negligible. Also, the displacement process of the reservoir fluid can be represented by a radial flow model.

However, if the wellbore is deviated, such methods do not enable profiling of the injection rate. Thus, deviated wellbores, such as horizontal wellbores, present greater problems in evaluating and predicting flow profiles for injection wells.

BRIEF SUMMARY OF THE INVENTION

In general, the present invention provides a system and methodology for using a well model in determining characteristics of an injection well. For example, the system and methodology enables the use of temperature profiles in a deviated injection well to determine a flow profile in such well.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for determining flow profiles in a deviated well. Temperature measurements are taken along a wellbore, and those measurements are used in determining flow profiles along a deviated injection well, such as a generally horizontal injection well. In some applications, a flow profile is derived based on data obtained during injection of a fluid into the deviated well. In other applications, a flow profile is derived based on data obtained during a shut-in period following injection or during periods of resumed injection.

A temperature sensing system, such as a distributed temperature sensor, is deployed with an operational completion and enables temperature measurements to be taken during fluid injection periods or during shut-in periods. Based on the collected temperature data, flow profiles of the injected fluid along the deviated well can be derived.

In general, when a cool fluid, such as a liquid, e.g. water or oil, or a gas, is injected into a hot reservoir, a variety of thermal changes occur. For example, during injection, cool fluid moves through the wellbore and into the reservoir while heat flows from the reservoir toward the wellbore. A similar effect occurs along the axis of the wellbore as fluid flows from the heel of the wellbore toward the toe, and heat flows from the toe of the wellbore toward the heel. The thermal characteristics of the heat flow can be modeled in a manner that enables determination of the flow profile of the fluid flow into the reservoir. Other factors, such as thermal conductivity of the surrounding formation, may also be utilized in modeling the flow profile, as discussed below.

Furthermore, if the injection of cool fluid is stopped, thereby creating a shut-in period, other unique thermal changes occur that enable the determination of injection profiles. For example, when the injection stops, the wellbore begins heating up, but not necessarily uniformly. The temperature recovery provides an indication of where the cool fluid was moving into the reservoir during injection. Reservoir intervals that were receiving substantial amounts of injection fluid, for example, are slower to rise in temperature during the shut-in period. These thermal changes are applied to models that enable the derivation of flow profiles, as discussed below.

Figure 1:
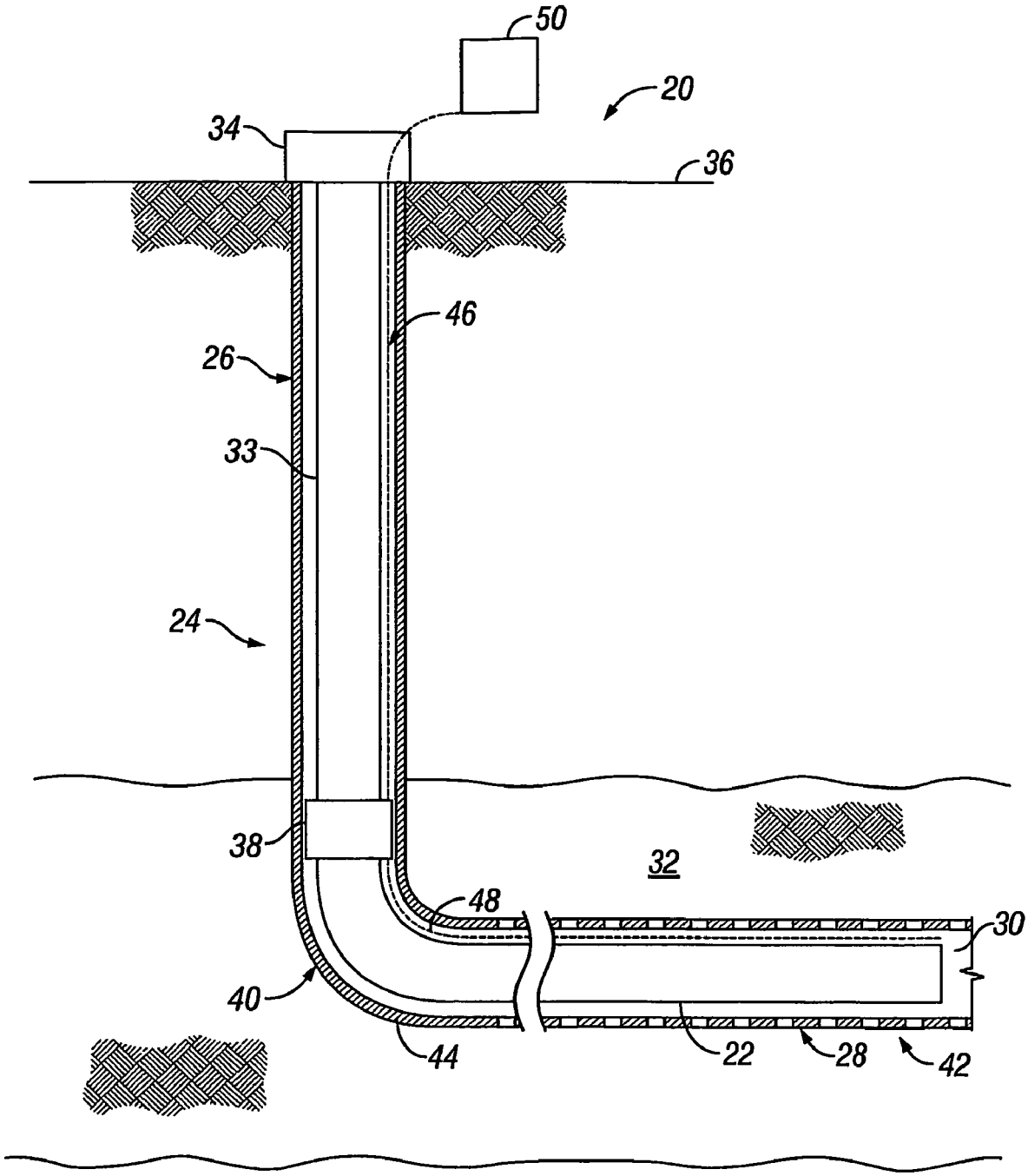
FIG. 1 is an elevation view of a completion and sensing system deployed in a deviated wellbore, according to an embodiment of the present invention.

Referring generally to FIG. 1, a system 20 is illustrated in accordance with an embodiment of the present invention. System 20 comprises a completion 22 deployed in a well 24. In this example, well 24 is a deviated well having a generally vertical section 26 and a deviated section 28, such as the generally horizontal section illustrated in FIG. 1. Well 24 is defined by a wellbore 30 drilled in a formation 32 having, for example, one or more fluids, such as oil and water. A tubing 33 extends downwardly into wellbore 30 from a wellhead 34 disposed, for example, along a seabed floor or a surface of the earth 36. In the illustrated example, tubing 33 extends to a casing shoe 38 that may be located at the lower end of vertical section 26 above a heel 40 of deviated section 28. Completion 22 is disposed in deviated section 28 and may extend from casing shoe 38 through heel 40 toward a toe 42 of well 24. In many applications, wellbore 30 is lined with a casing 44 that may be perforated to enable fluid flow therethrough.

As further illustrated, system 20 comprises a temperature sensing system 46. For example, temperature sensing system 46 may comprise a distributed temperature sensor (DTS) 48 that is able to continually sense temperature along deviated section 28 of wellbore 30 at multiple locations. Distributed temperature sensor 48 may be coupled to a controller 50 able to receive and process the temperature data obtained along wellbore 30. As discussed in greater detail below, controller 50 also enables use of the temperature data in conjunction with a model of the well to derive injection flow profiles of fluid flowing from completion 22 into formation 32 along deviated section 28 of the well 24.

During injection, a fluid, such as water, is pumped down through tubing 33 and into completion 22 along the illustrated horizontal section of the well. The fluid is forced outwardly along deviated section 28 such that fluid flows from completion 22 into formation 32, as indicated by arrows 52 of FIG. 2. The infectivity profile or flow profile of fluid moving from the wellbore 30 into formation 32 often is not uniform. For example, the flow may be substantially greater in proximity to heel 40 as opposed to toe 42. Also, the formation material may vary along the length of deviated section 28, which can extend a substantial distance, e.g. up to several kilometers.

Figure 3:
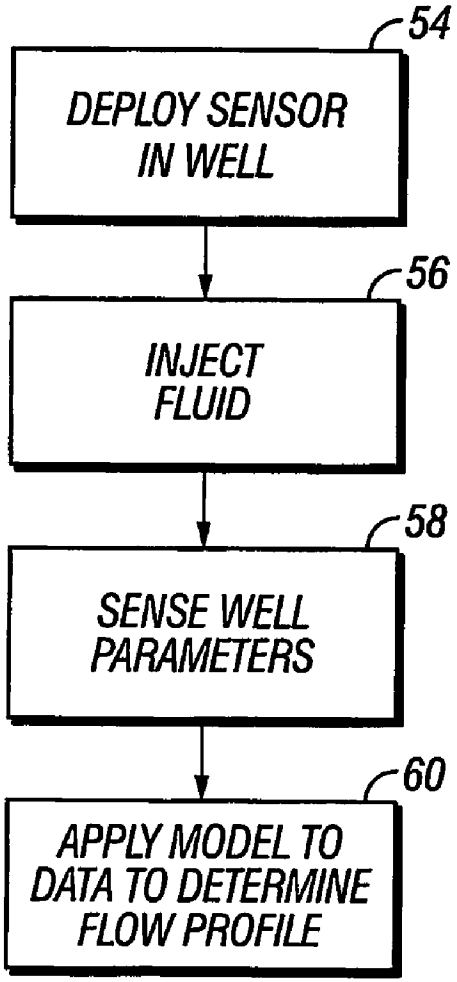
FIG. 3 is a flowchart generally representing an embodiment of the methodology used in determining a flow profile in a well, according to an embodiment of the present invention.

Referring generally to FIG. 3, an example of the methodology of the present invention is illustrated in flow chart form. Determining flow profiles along a given injection well comprises deploying a sensor system in the well with an operable injection completion, as illustrated by block 54. Then, an injection fluid is injected into formation 32 via completion 22, as illustrated by block 56. The sensor system may comprise a distributed temperature sensor designed to sense temperature along deviated wellbore section 28, as illustrated by block 58. As discussed more fully below, the sensing of well parameters can be done during injection and/or subsequent to injection during a shut-in period. A well model may then be applied to determine the flow profile of injected fluid along deviated section 28 of well 24, as illustrated by block 60.

Figure 2:
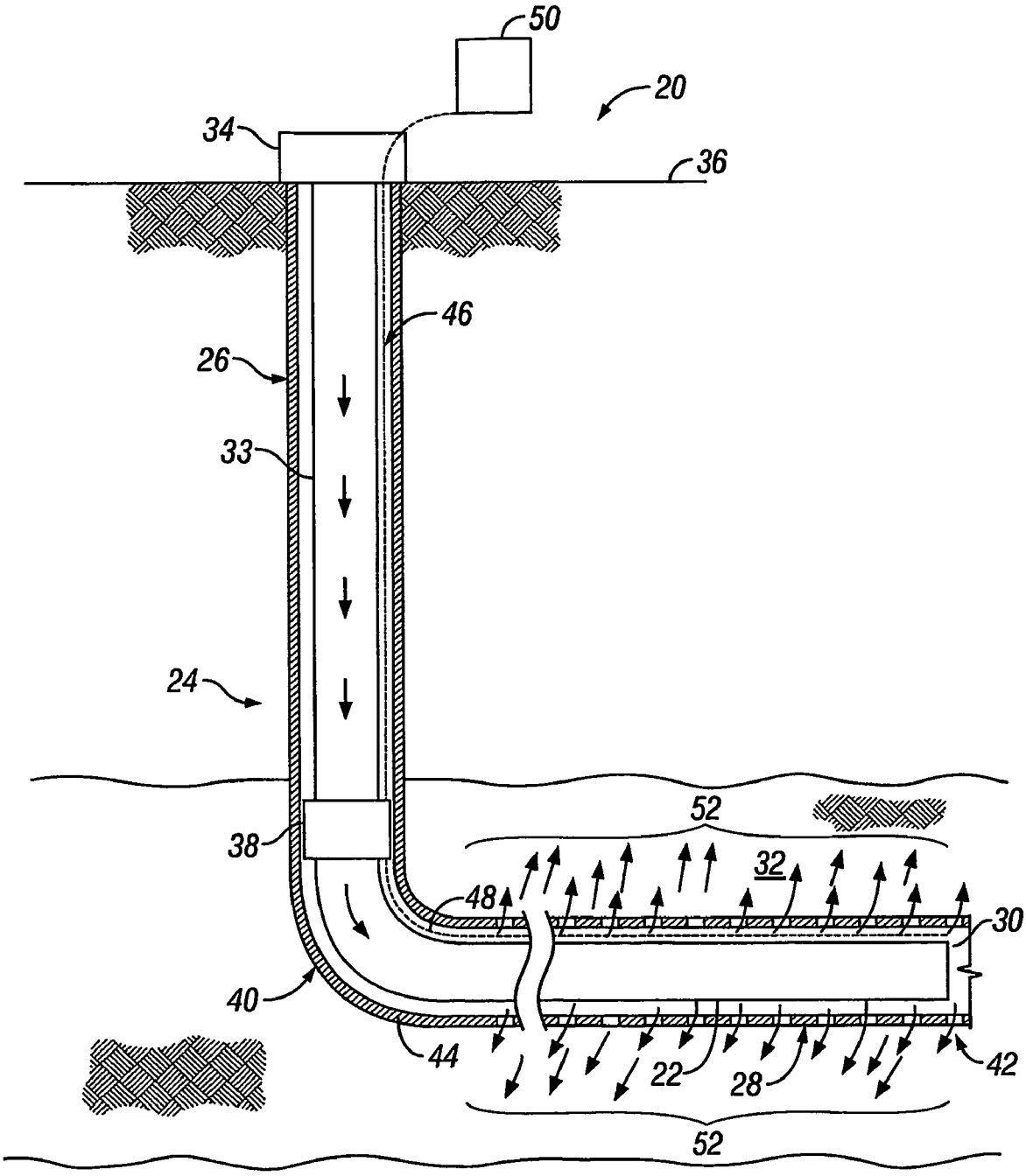
FIG. 2 is an elevation view of the system illustrated in FIG. 1 illustrating a fluid being injected into the well, according to an embodiment of the present invention.
Figure 4:
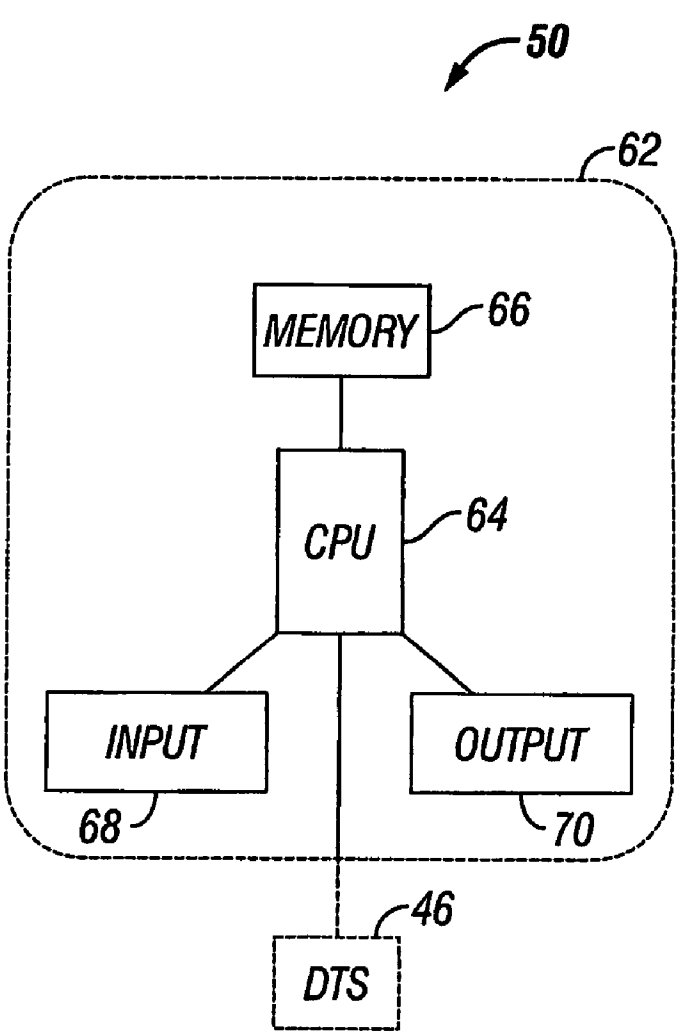
FIG. 4 is a diagrammatic representation of a processor-based control system that can be used to carry out all or part of the methodology for determining flow profile in a given well, according to an embodiment of the present invention.

Some or all of the methodology outlined with reference to FIGS. 1-3 may be carried out by controller 50 which comprises an automated system 62, such as the processing system diagramatically illustrated in FIG. 4. Automated system 62 may be a computer-based system having a central processing unit (CPU) 64. CPU 64 may be operatively coupled to temperature sensing system 46, a memory 66, an input device 68, and an output device 70. Input device 68 may comprise a variety of devices, such as a keyboard, mouse, voice-recognition unit, touchscreen, other input devices, or combinations of such devices. Output device 70 may comprise a visual and/or audio output device, such as a monitor having a graphical user interface. Additionally, the processing may be done on a single device or multiple devices at the well location, away from the well location, or with some devices located at the well and other devices located remotely.

Figure 5:
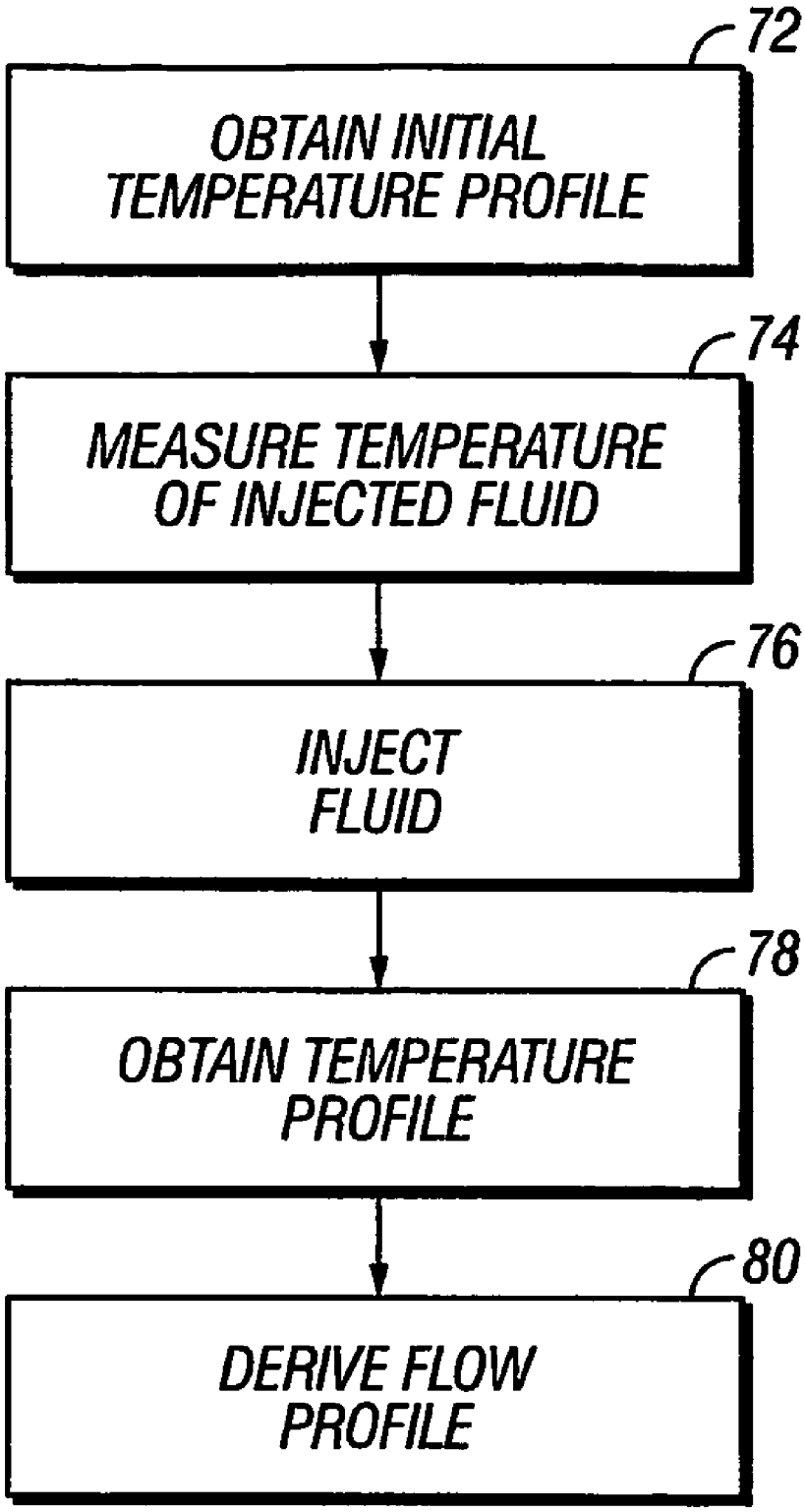
FIG. 5 is a flowchart generally representing a methodology for determining flow profiles based on temperature profiles during fluid injection into a deviated well, according to an embodiment of the present invention.

In automatically determining a flow profile or profiles of fluid injected into formation 32, a model utilizing temperature changes along deviated section 28 as an indicator of flow profiles may be stored by automated system 62 in, for example, memory 66. As illustrated best in FIG. 5, the general approach involves obtaining an initial temperature profile along at least deviated well section 28, as indicated by block 72. Additionally, the temperature of the injected fluid, e.g. water, is measured, as indicated by block 74. This value also may be stored on automated system 62 for use in modeling the infectivity profile. In many applications of the modeling technique, a greater contrast between the temperature of the injected fluid and the temperature of the reservoir can improve the usefulness of the model. By way of example, the injected fluid may be at a temperature of 60-70 degrees Fahrenheit, and a reservoir may be at a temperature of 200-240 degrees Fahrenheit. However, the temperature of the injected fluid and the reservoir can vary substantially from one application and environment to another. The fluid is then injected, as illustrated by block 76. Subsequently, temperature profiles are obtained along the deviated section 28, and this data is provided to automated system 62 via the temperature sensing system 46, as illustrated by block 78. The temperature profiles can be taken during injection or during a shut-in period subsequent to injection depending on the particular model applied. In either event, the model is used to derive a flow profile of the injected fluid, as illustrated by block 80. For example, the data collected may be processed according to the model/algorithm stored on automated system 62 to automatically present a well operator with detailed information on the injection flow profile via, for example, output device 70.

Figure 6:
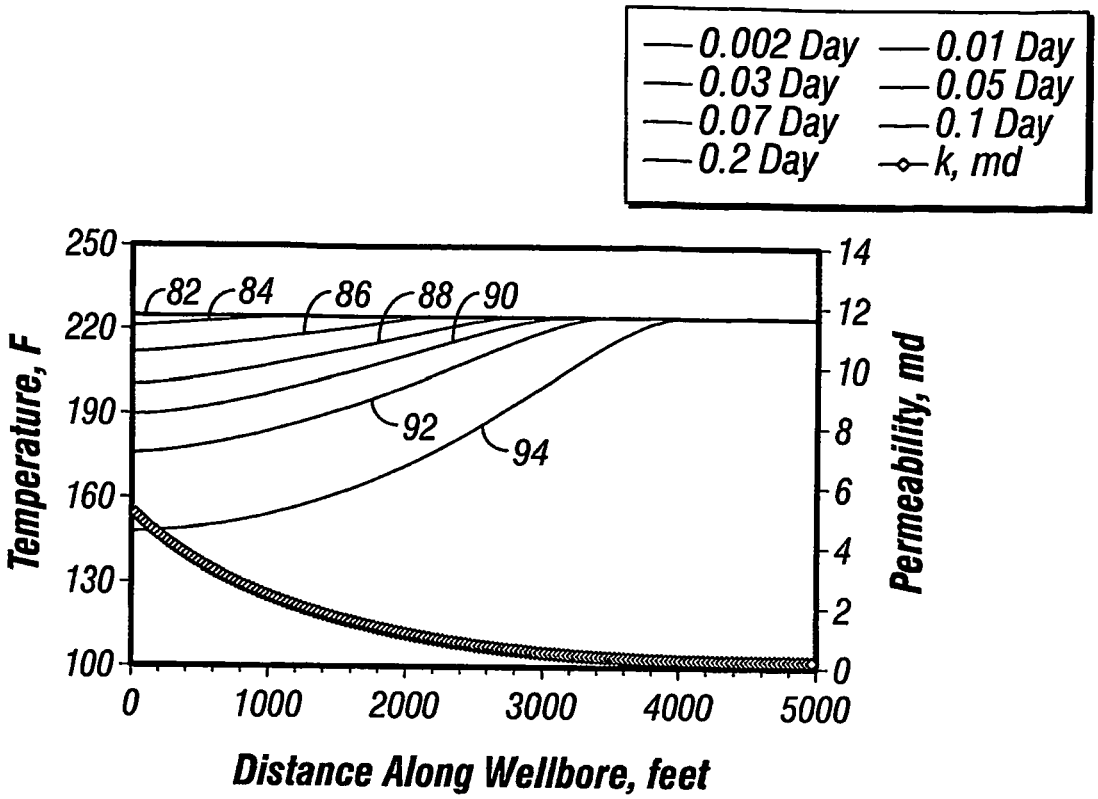
FIG. 6 is a graphical representation plotting temperature against distance along a wellbore during an early period of injection.

In determining the flow profiles, a given a well model may utilize thermal behavior characteristics that occur during injection. An example of a well in which injectivity decays along a horizontal well axis is illustrated in FIG. 6 which provides a graph of temperature plotted against distance along the horizontal section of the wellbore. The graph illustrates temperature changes along the horizontal wellbore section during the first few hours of injection. As illustrated by a graph line 82 at 0.002 day, graph line 84 at 0.01 day, graph line 86 at 0.03 day, graph line 88 at 0.05 day, graph line 90 at 0.07 day, graph line 92 at 0.1 day, and graph line 94 at 0.2 day, a gradual propagation of the temperature front in the wellbore is observed due to a much greater injectivity towards heel 40 than toe 42. A cooling or reduction of the temperature at heel 40 is also graphically illustrated.

Figure 7:
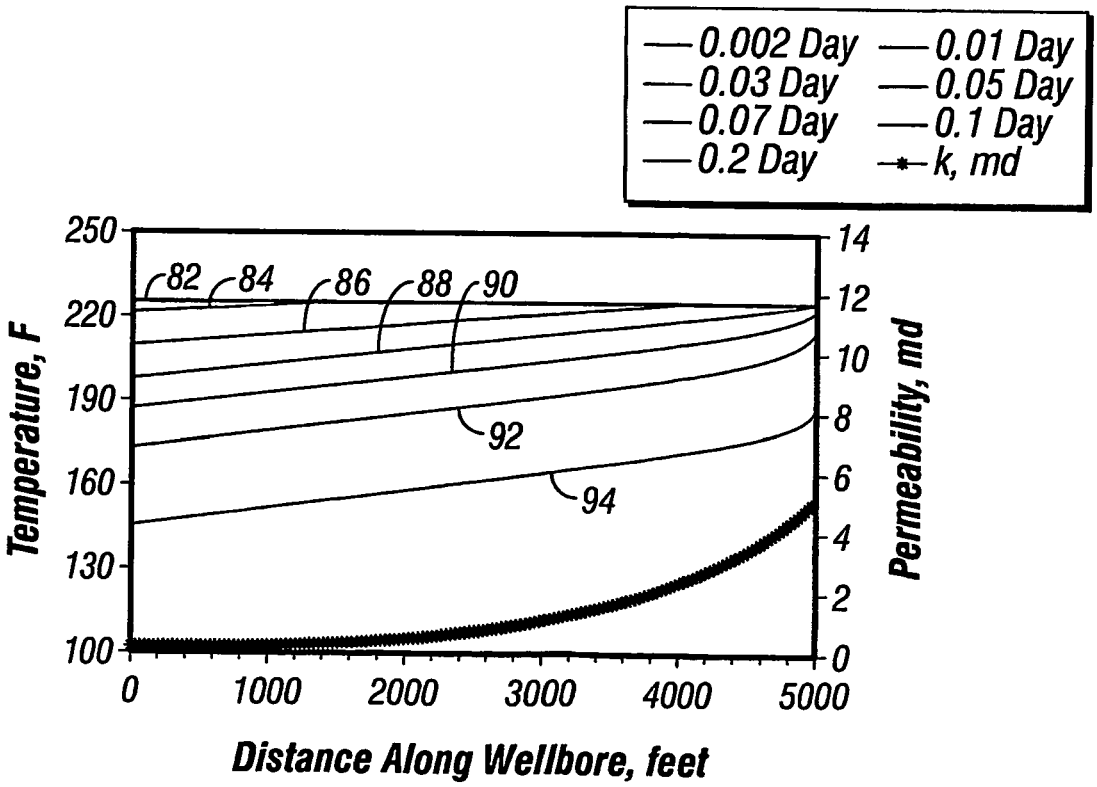
FIG. 7 is a graphical representation similar to that of FIG. 6 but with a different injection geometry.

The thermal characteristics of a well in which injectivity is skewed towards toe 42 is illustrated in FIG. 7. In this example a much faster propagation of the wellbore temperature front is observed, as indicated by the location of graph lines 82, 84, 86, 88, 90, 92, and 94.

Figure 8:
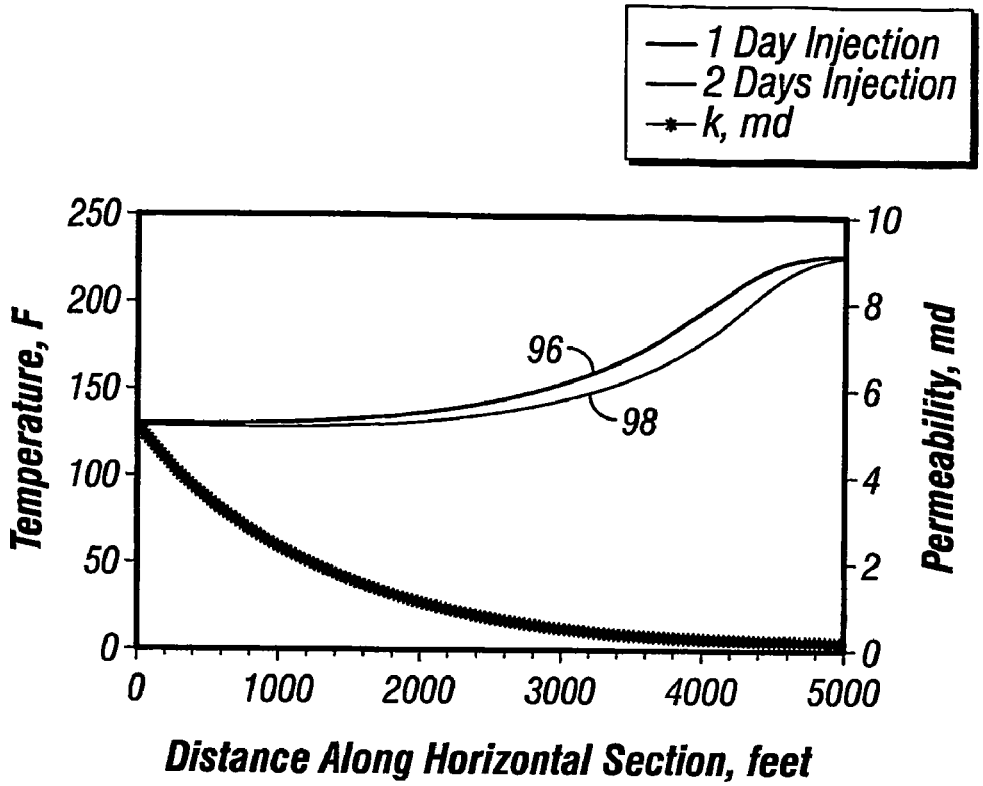
FIG. 8 is a graphical representation similar to that of FIG. 6 but at a later injection time.
Figure 9:
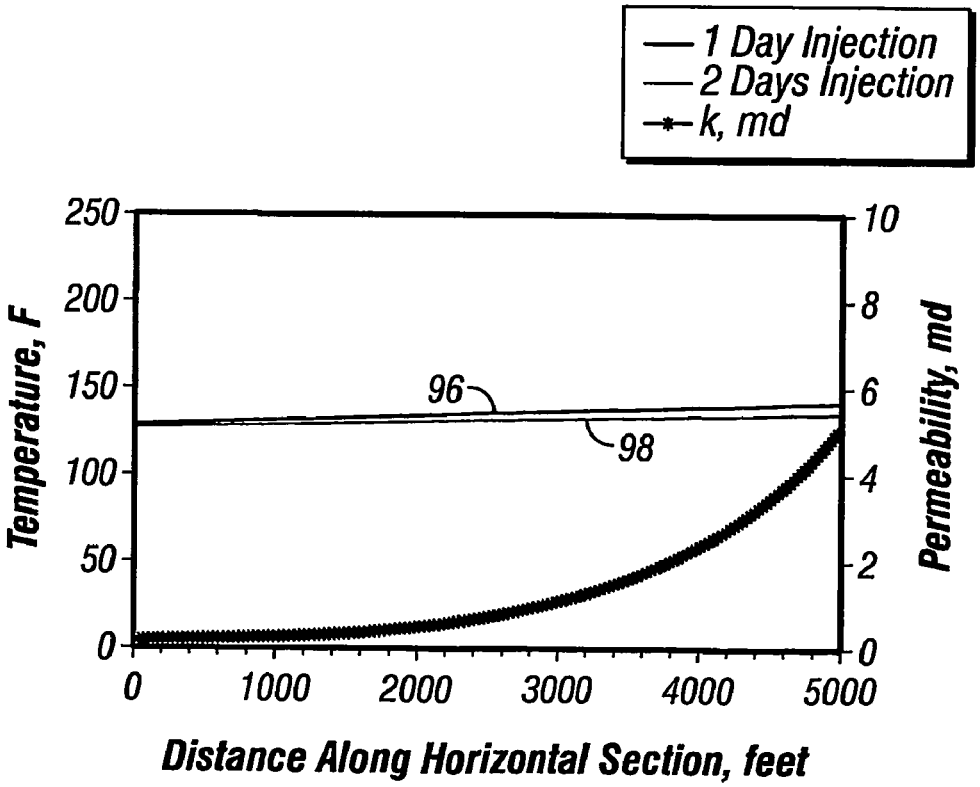
FIG. 9 is a graphical representation similar to that of FIG. 7 but at a later injection time.

Referring generally to FIGS. 8 and 9, temperature profiles for the examples provided in FIGS. 6 and 7, respectively, are again graphically illustrated, but at a substantially later period of the injection. In each of these figures, a graph line 96 represents a temperature profile after one day of injection, and a graph line 98 represents a temperature profile after two days of injection. The thermal characteristics, such as those illustrated in FIGS. 6, 7, 8 and 9, demonstrate thermal changes that occur during injection of fluid into formation 32. Those thermal changes can be used by an appropriate model to determine flow profiles. In other words, the injection of a cooler fluid into the reservoir at different rates along deviated section 28 creates thermal changes over the period of injection. By accurately measuring the thermal changes via, for example, distributed temperature sensor 48, the actual injection flow profiles can be derived by the appropriate model.

At other phases of the process, useful thermal data also may be obtained. For example, following an injection phase, a shut-in phase can lead to interesting thermal events which can be modeled to provide an injection flow profile. When the injection of fluid starts, the wellbore begins heating, but not necessarily uniformly. The taking of temperature profiles during this temperature recovery period provides an indication of where the cooler injection fluid is moving into the reservoir during injection. For example, reservoir intervals receiving a greater flow of the cooler fluid are slower to regain heat during the shut-in period. Thus, the temperature profiles taken during a shut-in period can be used to determine injection flow profiles.

Figure 10:
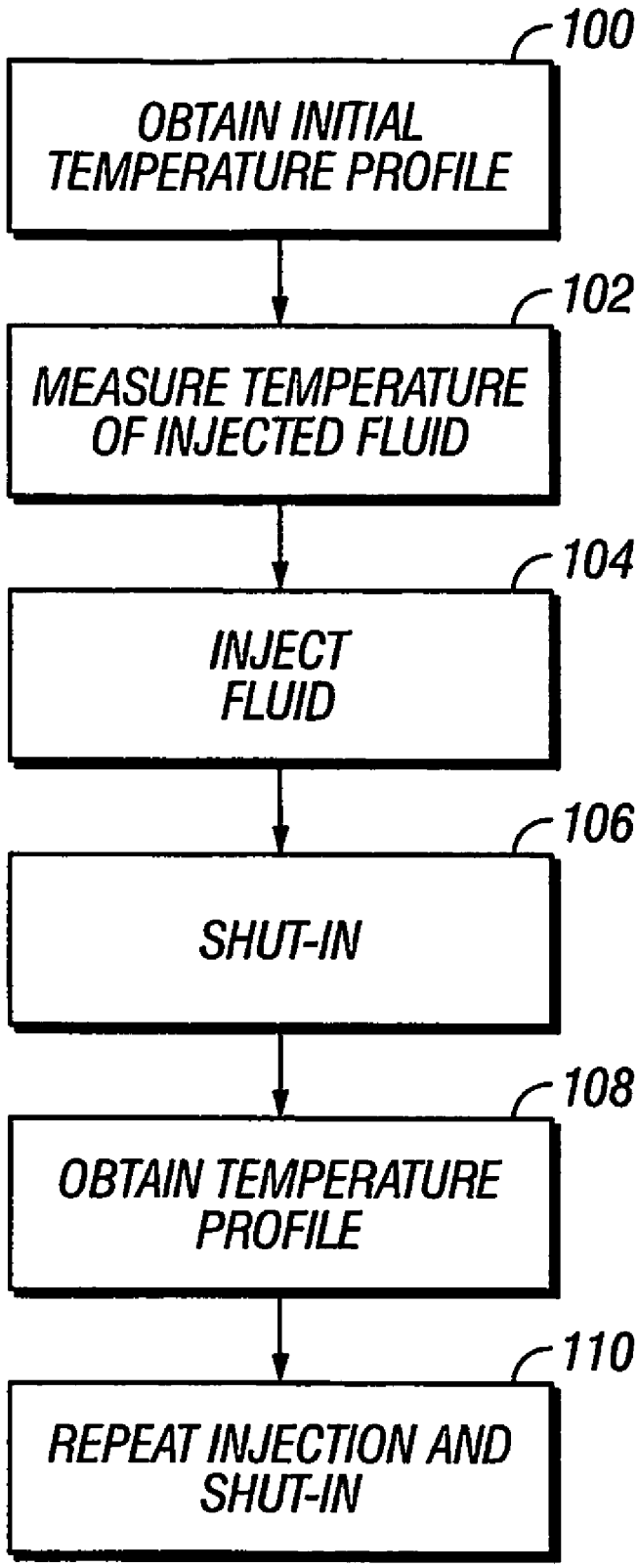
FIG. 10 is a flowchart generally representing a methodology for determining flow profiles based on temperature profiles in a deviated well during a shut-in period, according to an embodiment of the present invention.

As illustrated best in FIG. 10, the general methodology for utilizing shut-in data involves obtaining an initial temperature profile along at least deviated well section 28, as indicated by block 100. The temperature of the injected fluid, e.g. water, also is measured, as indicated by block 102. The injection fluid is then injected, as illustrated by block 104. Following an injection period, e.g. two days of injection, the injection is shut down for a shut-in period, as illustrated by block 106. Subsequently, temperature profiles are obtained along the deviated section 28, as illustrated by block 108. This data, along with other collected data, may be provided to automated system 62 via the temperature sensing system 46. By applying the appropriate model, the shut-in temperature data can be utilized in deriving an injection flow profile along the deviated section 28 of well 24. In some applications, the injection is resumed, and that resumed injection may be followed by a subsequent shut-in period, as indicated by block 110. The repeating of injection and shut-in periods can be used to obtain additional data, to verify results, and/or to continually monitor the injection flow profile. It should also be noted that appropriate models can also be designed to utilize the thermal characteristics of a well when injection is resumed after a shut-in period. As the fluid is reinjected, the well warms up and a step rise in temperature is indicated. This step or slug moves as a front along the deviated section of the wellbore and provides an indication of the flow profile. If, for example, the front moves slowly, this generally indicates greater flow towards the heel of the deviated section. If, on the other hand, the front moves more rapidly, this can indicate greater flow toward the toe of the wellbore.

Figure 11:
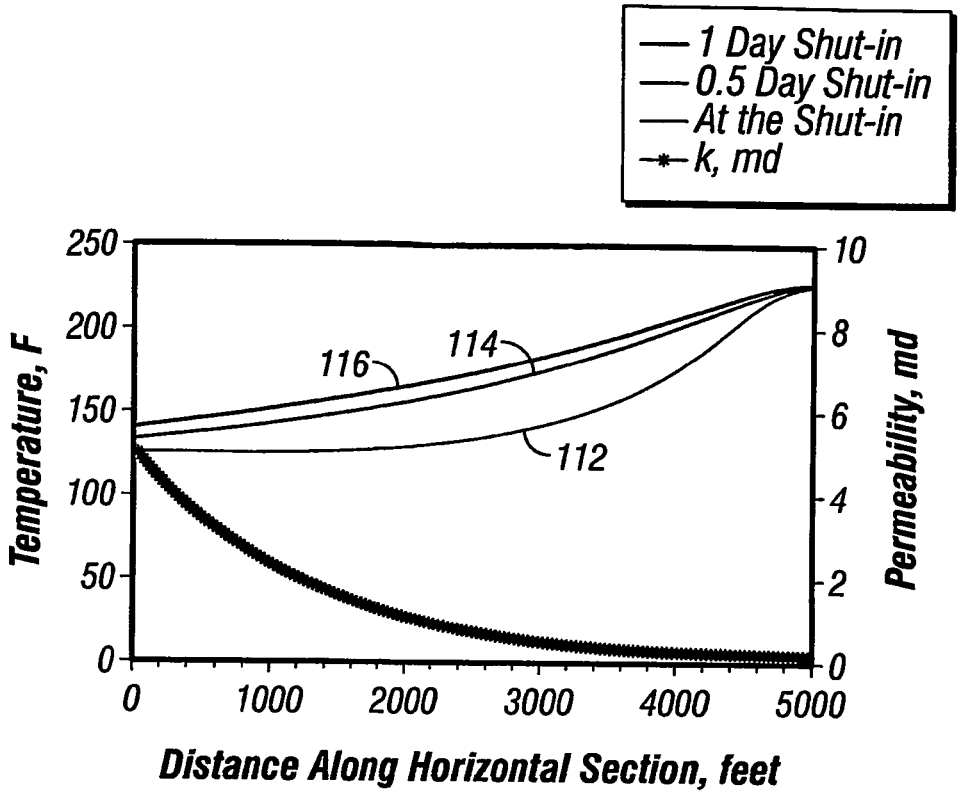
FIG. 11 is a graphical representation plotting temperature against distance along a wellbore during a shut-in period.
Figure 12:
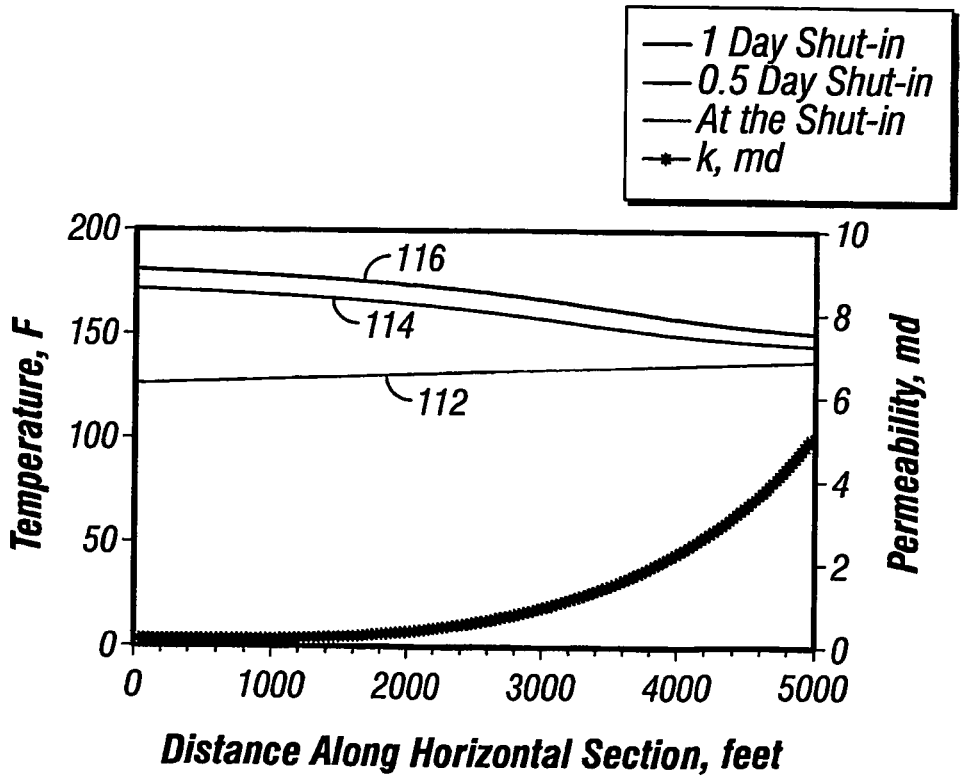
FIG. 12 is a graphical representation similar to that of FIG. 11 but with a different injection geometry.

In determining the flow profiles based on data obtained during the shut-in period, the well model utilizes thermal characteristics that occur during shut-in. In FIGS. 11 and 12, graphs of temperature plotted against distance along the horizontal section of the wellbore are provided for the scenarios described above with reference to FIGS. 6 and 7. However, the data graphically illustrated in FIGS. 11 and 12 represents temperature profiles taken during a shut-in period following the injection period illustrated graphically for a first scenario in FIGS. 6 and 8 and for a second scenario in FIGS. 7 and 9, respectively. The graphs of FIGS. 11 and 12 illustrate temperature changes along the horizontal wellbore section at various time points of the shut-in. Specifically, the temperature changes are indicated by a graph line 112 providing a temperature profile at the start of the shut-in period, a graph line 114 providing a temperature profile at 0.5 days into the shut-in, and a graph line 116 providing a temperature profile at 1 day into the shut-in period. From the temperature profile data, it becomes apparent that the temperature rebounds quickly at intervals of the deviated wellbore having a lower rate of injection. On the contrary, intervals with greater infectivity, i.e. a greater rate of flow into the reservoir, rebound more slowly. The differences in thermal characteristics of the temperature recovery along the length of the deviated well enable determination of the injection flow profile.

Figure 13:
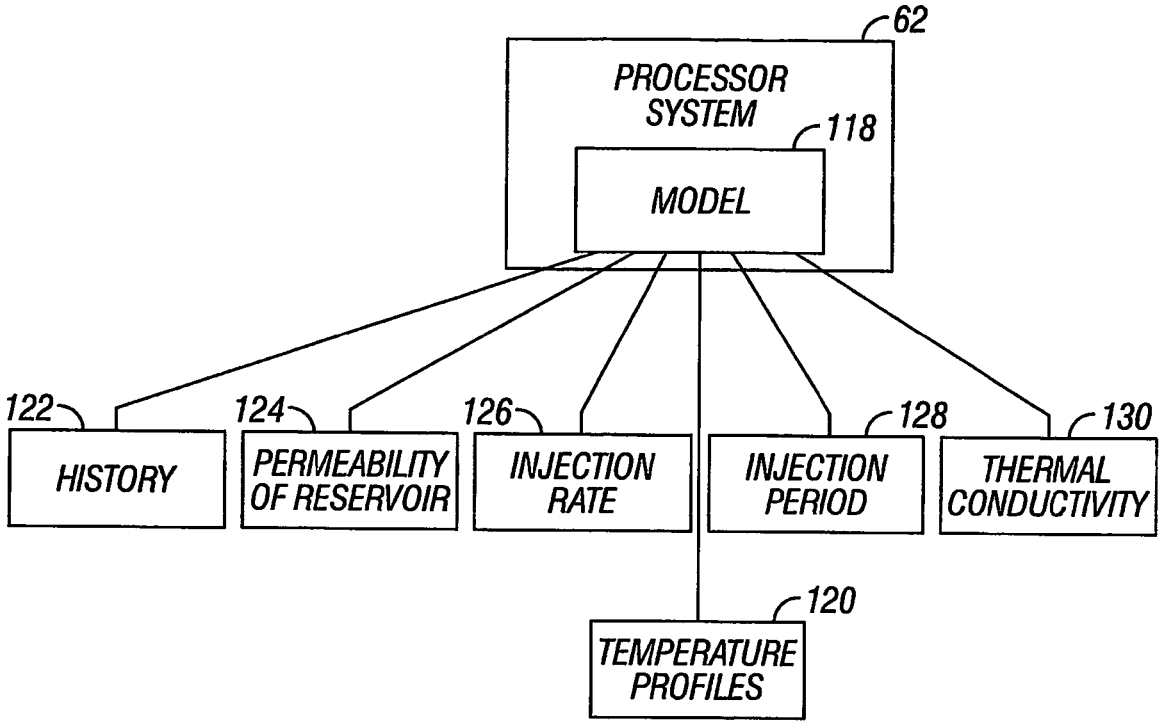
FIG. 13 is a schematic representation of a processor system that receives data related to temperature profiles and other well parameters to derive flow profiles.

In some applications, the accuracy of the flow profiles can be improved by accounting for additional well related parameters. As illustrated in FIG. 13, the use of a subject model 118 can include additional inputs other then the primary input of temperature profiles 120. In this example, the model is utilized or processed on automated processor system 62, and a variety of data is fed into the model and processor system 62 via, for example, sensors or manual input via input device 68. For example, temperature profile data 120 may be provided by distributed temperature sensor 48. Other well related parameters, such as recent history 122, permeability of the reservoir 124, injection rate 126, injection period 128, and/or thermal conductivity 130, can be utilized by model 118 on processor system 62 to provide reliable injection flow profiles to a well operator.

A specific model/algorithm for determining flow profiles based on thermal data obtained during injection of fluid may take a variety of physical phenomena into account. For example, the injection of a cool fluid into a relatively hot reservoir creates both a flow of fluid and a flow of heat. Cool or cold fluid moves through the wellbore and into the reservoir as heat flows from the reservoir toward the wellbore. A similar effect occurs along the wellbore axis in that fluid flows from the heel to the toe, and heat flows from the toe to the heel.

A practical model to predict the temperature distribution along the wellbore when the injection flux is specified, or to estimate the injection flux distribution with measured temperature profile can be described as follows. Initial assumptions are set forth in the following points:

(1) The pressure and temperature gradient in the direction parallel to the axis of the horizontal well (x) are much smaller than those in the directions (y and z) perpendicular to the axis. So, the mass and heat transference along x-direction can be neglected.

(2) The viscosity and density of oil and water are constants. So, the pressure and water saturation distribution are independent of temperature.

(3) Isotropic formation.

(4) Incompressible injected fluid.

(5) Open hole completion.

The wellbore model in this embodiment further utilizes a wellbore flow rate distribution equation and a temperature distribution equation described below.

(1) Wellbore flow rate distribution equation

Let $Q_{wi}(x,t)$ denote the injected fluid volume flow rate along the wellbore ($m^3$/hour), and $q_{wi}(x,t)$ denote the fluid volume rate injected into the formation for unit length of the wellbore ($m^2$/hour). The mass conservation of injected fluid in the wellbore gives:

$$Q_{wi}(x, t) - Q_{wi}(x + dx, t) - q_{wi}(x, t)dx = 0 \tag{1.1}$$

$$\frac{\partial Q_{wi}}{\partial x} = -q_{wi}(x, t)$$

Integrating equation (1.1) from the heel to toe yields:

$$Q_{inj}(t) = Q_{wi}(0, t) = \int_0^L q_{wi}(x, t)dx \tag{1.2}$$

$$Q_{wi}(x, t) = Q_{inj}(t) - \int_0^x q_{wi}(\xi, t)d\xi$$

where $Q_{inj}(t)$ is the total injection rate at the heel of a horizontal well.

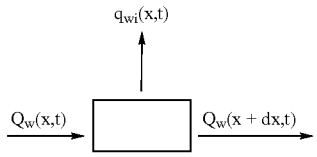

Wellbore Flow Rate Distribution (2) Temperature distribution equation:

The total heat stored in the tiny element dx is:

$$Q_{well}=c_iA_wT_w(x,t)dx \tag{1.3}$$

$$\text{Let } q_{Tw}(x, t) = 2\pi r_w\eta\left(\frac{\partial T}{\partial r}\right)_{r=r_w}$$

denote the heat flow rate from the formation into the unit length wellbore and $T_w(x,t)$ denote the temperature profile along the wellbore. The energy conservation equation for element dx is:

$$\frac{\partial Q_{well}}{\partial t} = q_{win} - q_{wout} \tag{1.4}$$

where $q_{win}$ and $q_{wout}$ denote the heat rate flowing into and out of the tiny wellbore element dx. $q_{win}$ is composed of two terms: the heat carried by the fluid flowing into the element through the wellbore cross-sectional area at x, $c_iQ_{wi}(x,t)T_W(x,t)$, and the heat flowing from the formation to the wellbore element through the wellbore surface due to heat conduction, $q_{Tw}(x,t)dx$. $q_{wout}$ is also composed of two terms: the heat carried by the fluid flowing out of the element through the wellbore cross-section area at x+dx, $c_iQ_{wi}(x+dx,t)T_w(x+dx, t)$, and the heat carried by the fluid flowing out of the element through the wellbore surface, $c_iq_{wi}(x,t)T_W(x,t)dx$.

$$q_{win} = c_iQ_{wi}(x, t)T_W(x, t) + q_{Tw}(x, t)dx$$

$$q_{Tw}(x, t) = 2\pi\eta r_w\left(\frac{\partial T}{\partial r}\right)_{r=r_w}$$

$$q_{wout} = c_iQ_{wi}(x + dx, t)T_W(x + dx, t) + c_iq_{wi}(x, t)dx.$$

Substituting $q_{win}$, $q_{out}$ and equation (1.3) into (1.4) gives:

$$-c_i\frac{\partial(Q_{wi}T_w)}{\partial x} + 2\pi\eta r_w\left(\frac{\partial T}{\partial r}\right)_{r=r_w} - c_iq_{wi}T_w = c_iA_w\frac{\partial T_w}{\partial t}.$$

Substituting equation (1.1) into the above equation yields:

$$-c_iQ_{wi}\frac{\partial T_w}{\partial x} + 2\pi r_w\eta\left(\frac{\partial T}{\partial r}\right)_{r=r_w} = c_iA_w\frac{\partial T_w}{\partial t} \tag{1.5}$$

where $c_i$—heat capacity of injected fluid (J/(m$^3$.° K.));

$A_w$—flowing area in the wellbore (m$^2$); and $\eta$—thermal conductivity of the formation (J/(m.° K.h)).

Near Wellbore Heat Transportation—Water Injection

The near wellbore flow regime can be regarded as steady-state radial flow. Consider a tiny radial element between r and r+dr. The total heat stored in this element for water injection is composed of three terms: the heat stored in the water phase $Q_w=2\pi rdr\phi s_w(x,r,t)c_wT(x,r,t)$, the heat stored in the oil phase $Q_o=2\pi rdr\phi[1-s_w(x,r,t)]c_oT(x,r,t)$, and the heat stored in the rock $Q_r=2\pi rdr(1-\phi)c_rT(x,r,t)$, i.e., $$Q_{res} = Q_w + Q_o + Q_r \tag{1.6}$$

$$= 2\pi rdrT(x, r, t)[s_w(x, r, t)\phi(c_w - c_o) + c_o\phi + (1 - \phi)c_r]$$

where T(x,r,t) is the temperature distribution in the reservoir, $\phi$ is porosity, $c_o$ is the heat capacity of oil (J/(m$^3$.° K.)), and $s_w(x,r,t)$ is water saturation.

$$\text{Let } q_T(x, r, t) = 2\pi\eta r\frac{\partial T}{\partial r}$$

denote the heat inward radial flow rate, $q_w(x,r,t)$ denote the water volume outward radial flow rate, and $q_o(x,r,t)$ denote the oil volume outward radial flow rate. The energy conservation equation for this radial element is:

$$\frac{\partial Q_{res}}{\partial t} = q_{rin} - q_{rout} \tag{1.7}$$

where $q_{rin}$ and $q_{rout}$ denote the heat rate flowing into and out of the tiny radial element dr. $q_{rin}$ is composed of two terms: the heat carried by the oil and water flowing into the element through the inner surface at r, $[c_wq_w(x,r,t)+c_oq_o(x,r,t)]T(x,r,t)$, and the heat flowing into the element through the outer surface at r+dr due to heat conduction, $q_T(x,r+dr,t)$. $q_{rout}$ is also composed of two terms: the heat carried by the oil and water flowing out of the radial element through the outer surface at r+dr, $[c_wq_w(x,r+dr,t)+c_oq_o(x,r+dr,t)]T(x,r+dr,t)$, and the heat flowing out of the tiny element through the inner surface at r due to heat conduction, $q_T(x,r,t)$.

$$q_{rin} = [c_w q_w(x, r, t) + c_o q_o(x, r, t)]T(x, r, t) + q_T(x, r + dr, t)$$

$$q_{rout} = [c_w q_w(x, r + dr, t) + c_o q_o(x, r + dr, t)]T(x, r + dr, t) + q_T(r, t)$$

$$q_T(x, r, t) = 2\pi\eta r\frac{\partial T}{\partial r}.$$

Substituting the above equations and equation (1.6) into equation (1.7) yields:

$$[s_w(x, r, t)\phi(c_w - c_o) + c_o\phi + (1 - \phi)c_r]\frac{\partial T}{\partial t} + \phi(c_w - c_o)T(x, r, t)\frac{\partial s_w}{\partial t} = \frac{1}{2\pi r}\left[2\pi\eta\frac{\partial}{\partial r}\left(r\frac{\partial T}{\partial r}\right) - c_w\frac{\partial(q_w T)}{\partial r} - c_o\frac{\partial(q_o T)}{\partial r}\right] \tag{1.8}$$

Let $r_{wf}(x,t)$ denote the water front at time t, and choose $r \leqq r_{wf}(x,t)$. Then:

$$s_w(x,r,t)=1-s_{or},\ q_w(x,r,t)=q_{wi}(x,t),\ q_o(x,r,t)=0$$

Near the wellbore, the heat flux also can be considered as a constant, i.e., $$2\pi\eta\frac{\partial}{\partial r}\left(r\frac{\partial T}{\partial r}\right) = \frac{\partial q_T}{\partial r} = 0.$$

Equation (1.8) becomes:

$$[(1 - s_{or})\phi(c_w - c_o) + c_o\phi + (1 - \phi)c_r]\frac{\partial T}{\partial t} = -\frac{c_w q_{wi}(x, t)}{2\pi r}\frac{\partial T}{\partial r}. \tag{1.9}$$

At the wellbore ($r=r_w$), and:

$$[(1 - s_{or})\phi(c_w - c_o) + c_o\phi + (1 - \phi)c_r]\frac{\partial T_w}{\partial t} = -\frac{c_w q_{wi}(x, t)}{2\pi r_w}\left(\frac{\partial T}{\partial r}\right)_{r=r_w}. \tag{1.10}$$

Combining equation (1.10) with equation (1.5) and choosing $c_i=c_w$ yields:

$$\left\{\frac{(2\pi r_w)^2\eta}{c_w q_{wi}(x, t)}[(1 - s_{or})\phi(c_w - c_o) + c_o\phi + (1 - \phi)c_r] + c_w A_w\right\}\frac{\partial T_w}{\partial t} = -c_w Q_{wi}\frac{\partial T_w}{\partial x}. \tag{1.11}$$

Let:

$$a_{1w} = (1 - s_{or})\phi\left(1 - \frac{c_o}{c_w}\right) + \phi\frac{c_o}{c_w} + (1 - \phi)\frac{c_r}{c_w},$$

$$a_2 = \frac{\pi r_w^2}{A_w}$$

-continued $$a_w(x, t) = \frac{Q_{wi}(x, t)}{LA_w\left(1 + a_{1w}a_2\frac{4\pi\eta}{c_w q_{wi}(x, t)}\right)}$$

Equation (1.11) becomes:

$$\frac{\partial T_w}{\partial t} + La_w(x, t)\frac{\partial T_w}{\partial x} = 0 \tag{1.12}$$

Near Wellbore Heat Transportation—Oil Injection

For oil injection, the water phase flow rate is $q_w(x,r,t)=0$ and water saturation is $s_w(x,r,t)=s_{wi}$. The total heat stored in the radial element is composed of three terms: the heat stored in the water phase $Q_w=2\pi r dr\phi s_{wi}c_w T(x,r,t)$, the heat stored in the oil phase $Q_o=2\pi r dr\phi[1-s_{wi}]c_o T(x,r,t)$, and the heat stored in the rock $Q_r=2\pi r dr(1-\phi)c_r T(x,r,t)$, i.e., $$Q_{res} = Q_w + Q_o + Q_r = 2\pi r dr T(x, r, t)[s_{wi}\phi(c_w - c_o) + c_o\phi + (1 - \phi)c_r].$$

Similarly:

$$q_{rin}=c_o q_o(x,r,t)T(x,r,t)+q_T(x,r+dr,t)$$

$$q_{rout}=c_o q_o(x,r+dr,t)T(x,r+dr,t)+q_T(r,t).$$

The energy conservation equation for this radial element is: Substituting the above equations into equation (1.7) yields:

$$[s_{wi}\phi(c_w - c_o) + c_o\phi + (1 - \phi)c_r]\frac{\partial T}{\partial t} = \frac{1}{2\pi r}\left[2\pi\eta\frac{\partial}{\partial r}\left(r\frac{\partial T}{\partial r}\right) - c_o\frac{\partial(q_o T)}{\partial r}\right]. \tag{1.13}$$

In the steady state flow regime near the wellbore:

$$q_o(x, r, t) = q_{wi}(x, t),\ \frac{\partial}{\partial r}\left(r\frac{\partial T}{\partial r}\right) = 0.$$

And, equation (1.13) becomes:

$$[s_{wi}\phi(c_w - c_o) + c_o\phi + (1 - \phi)c_r]\frac{\partial T}{\partial t} = \frac{c_o q_{wi}(x, t)}{2\pi r}\frac{\partial T}{\partial r} \tag{1.14}$$

At the wellbore ($r=r_w$):

$$[s_{wi}\phi(c_w - c_o) + c_o\phi + (1 - \phi)c_r]\frac{\partial T_w}{\partial t} = -\frac{c_o q_{wi}(x, t)}{2\pi r_w}\left(\frac{\partial T}{\partial r}\right)_{r=r_w} \tag{1.15}$$

Combining equation (1.15) with equation (1.5) and choosing $c_i = c_o$ yields:

$$\left\{\frac{(2\pi r_w)^2\eta}{c_o q_{wi}(x,t)}[s_{wi}\phi(c_w - c_o) + c_o\phi + (1-\phi)c_r] + c_o A_w\right\}\frac{\partial T_w}{\partial t} = -c_o Q_{wi}\frac{\partial T_w}{\partial x}. \quad (1.16)$$

Let:

$$a_{1o} = s_{wi}\phi\left(1 - \frac{c_o}{c_w}\right) + \phi\frac{c_o}{c_w} + (1-\phi)\frac{c_r}{c_w},$$

$$a_2 = \frac{\pi r_w^2}{A_w}$$

$$a_o(x,t) = \frac{Q_{wi}(x,t)}{LA_w\left(1 + a_{1o}a_2\frac{4\pi\eta}{c_w q_{wi}(x,t)}\right)}.$$

Equation (1.16) becomes:

$$\frac{\partial T_w}{\partial t} + La_o(x,t)\frac{\partial T_w}{\partial x} = 0 \quad (1.17)$$

Boundary Condition and Initial Condition

The boundary condition is specified with the injection temperature at the heel (x=0):

$$T_w(0,t) = T_{w0}(t) \quad (1.18)$$

The temperature at the heel $T_{w0}(t)$ can be determined with a wellbore heat transmission model, such as the H. J. Ramey model.

The initial condition is:

$$T_w(x,0) = T_R \quad (1.19)$$

where $T_R$ is the reservoir temperature.

Wellbore Temperature Prediction—Forward Problem

When the reservoir properties (porosity $\phi$ and permeability k), fluid properties (density $\rho_o$ and $\rho_w$, viscosity $\mu_o$ and $\mu_w$, relative permeability $k_{ro}$ and $k_{rw}$), wellbore geometry (wellbore diameter $r_w$, fluid flow area $A_w$, roughness $\epsilon$, and the length of perforated section L) are specified, then the injection rate distribution $q_{wi}(x,t)$ can be determined with an analytical model, such as the model established by TUPREP, or a numerical model, such as the ECLIPSE100. And thus, with the properly defined boundary condition (1.18) and initial equation (1.19), the wellbore temperature profile $T_w(x,t)$ can be predicted by solving equation (1.12) for water injection or equation (1.17) for oil injection.

$$\text{Let } \bar{q}_0 = \frac{Q_{inj}(t_0)}{L}$$

denote the average injection flux at time $t = t_0$, and $$a_{Do}(x,t) = \frac{a_o(x,t)}{\bar{a}_o},$$

$$a_{Dw}(x,t) = \frac{a_w(x,t)}{\bar{a}_w}$$

-continued $$\bar{a}_w = \frac{\bar{q}_0}{A_w\left(1 + a_{1w}a_2\frac{4\pi\eta}{c_w\bar{q}_0}\right)},$$

$$\bar{a}_o = \frac{\bar{q}_0}{A_w\left(1 + a_{1o}a_2\frac{4\pi\eta}{c_w\bar{q}_0}\right)}.$$

Equations (1.12) and (1.17) can be rewritten as:

$$\frac{\partial T_w}{\partial t} + a_{Dw}(x,t)L\bar{a}_w\frac{\partial T_w}{\partial x} = 0 \quad (1.20)$$

$$\frac{\partial T_w}{\partial t} + a_{Do}(x,t)L\bar{a}_o\frac{\partial T_w}{\partial x} = 0. \quad (1.21)$$

The unit of $q_{wi}(x,t)$ and $\bar{q}_0$ is $$\frac{m^2}{\text{hour}},$$

so the unit of $\bar{a}_w$ and $\bar{a}_o$ is $$\frac{1}{\text{hour}}.$$

$$\text{Let } \zeta = \frac{x}{L},$$

$t_D = \bar{a}_w t$ for water injection or $t_D = \bar{a}_o t$ for oil injection. They denote the dimensionless variables. The dimensionless forms of equations (1.20) and (1.21) are:

$$\frac{\partial T_w}{\partial t_D} + a_{Dw}(\varsigma, t_D)\frac{\partial T_w}{\partial \varsigma} = 0 \quad (1.22)$$

$$\frac{\partial T_w}{\partial t_D} + a_{Do}(\varsigma, t_D)\frac{\partial T_w}{\partial \varsigma} = 0. \quad (1.23)$$

Or, both equations can be rewritten as:

$$\frac{\partial T_w}{\partial t_D} + a_{Di}(\varsigma, t_D)\frac{\partial T_w}{\partial \varsigma} = 0; \quad (1.24)$$

$$(i = o, w)$$

Let $\zeta_c(t_D)$ denote the characteristic curve along which the temperature is unchanging, i.e., $$dT_w = \frac{\partial T_w}{\partial t_D} + \frac{\partial T_w}{\partial \varsigma_c}\frac{d\varsigma_c}{dt_D} = 0. \quad (1.25)$$

Comparing equation (1.24) with (1.25) yields:

$$\frac{d\zeta_c}{dt_D} = a_{Di}(\zeta_c, t_D) \tag{1.26}$$

Equation (1.26) is the characteristic equation with respect to the partial differential equation (1.24). Equation (1.26) defines a group of curves, characteristic curves. It can be proved that all characteristic curves do not intersect with each other. If one characteristic curve crosses the positive $\zeta$ coordinate, then the temperature on this curve is specified by the initial condition, i.e., equal to the reservoir temperature $T_R$. Otherwise, the curve will cross the positive $t_D$ coordinate, and the temperature on this curve is specified by the boundary condition $T_w(t_{Dp})$, where $t_{Dp}$ is the intersection of the characteristic curve with the time coordinate.

The modeling technique described above enables the determination of injection flow profiles based in large part on temperature profiles obtained during injection of the fluid: However, the shut-in period also can be modeled such that injection flow profiles can be determined based on thermal information obtained during the shut-in period. Of course, the data obtained and modeled during the injection period and the shut-in period can both be used in determining an injection profile. Furthermore, the thermal data obtained when injection is resumed after a shut-in period or the data obtained from repeated injection and shut-in periods all can be combined to determine and/or verify an injection flow profile.

Figure 14:
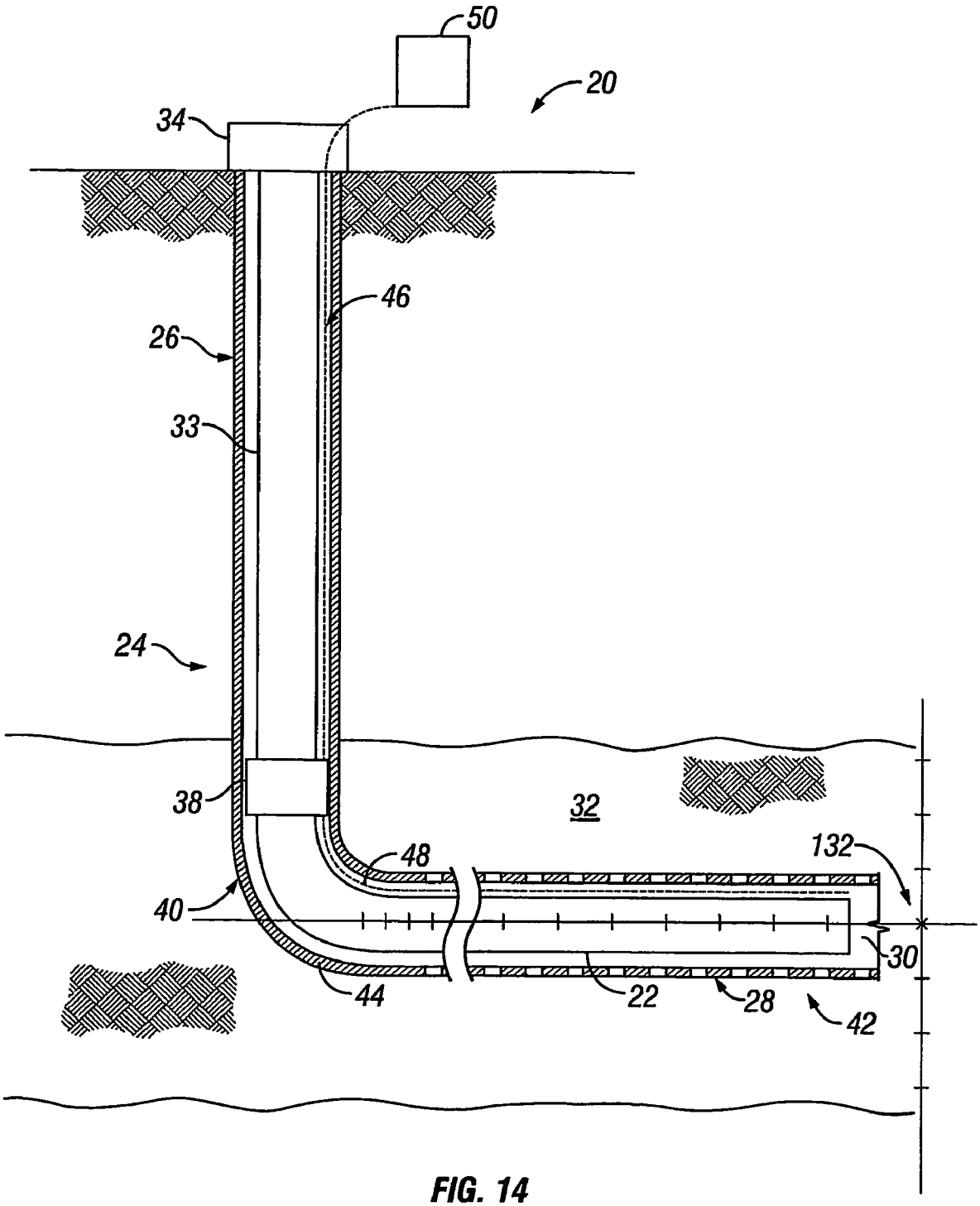
FIG. 14 is a schematic representation of a deviated well divided into a multi-segment grid system for modeling.

An example of a modeling technique that utilizes thermal data obtained during a shut-in period to derive injection flow profiles is described in the following paragraphs. First, it should be noted that the temperature profile in the wellbore is affected by the fluid convection and the heat conduction between the wellbore and the reservoir. Because the thermal behavior of the well depends on the temperature distribution around the wellbore, a refined grid block scheme can be used in modeling. As illustrated in FIG. 14, the model utilizes a grid system 132 that extends in the x, y, and z directions. By refining the grid size around the wellbore 30 the temperature profile can be stabilized. In other words, the model can utilize a grid system having a grid size selected such that further refinement of the individual grid sizes does not affect the temperature.

In this type of model, it can be assumed that the temperature distribution in the reservoir at the shut-in has the shape of two distinctive regions, one with average reservoir temperature and one with the temperature of the wellbore at the shut-in. The temperature behavior at the wellbore can be expressed as:

$$T_D = \frac{1}{2\alpha t} e^{\frac{r^2}{4\alpha t}} \int_0^{R_e} \zeta e^{\frac{\zeta^2}{4\alpha t}} I_o\left(\frac{r\zeta}{2\alpha t}\right) d\zeta, \tag{1.27}$$

Figure 15:
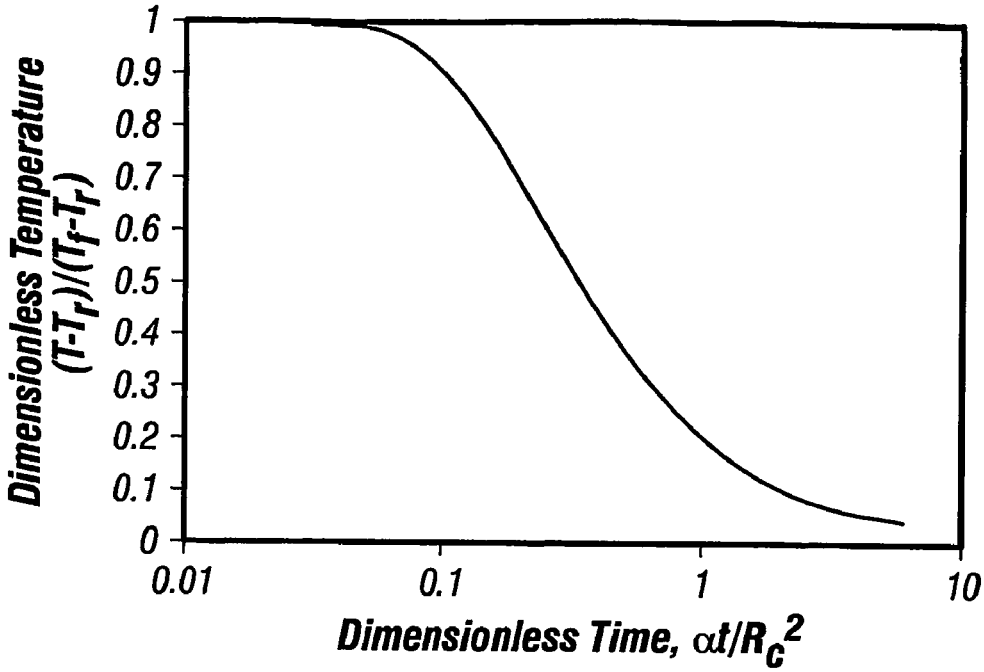
FIG. 15 is a graphical representation of dimensionless temperature plotted against dimensionless time.

The solution of this equation is illustrated in FIG. 15 in terms of the dimensionless temperature and dimensionless time. Assuming that the temperature front is the same as the saturation front, this solution can be used to relate the total injection liquid, water in this example, into each interval and the radius of the temperature front is as follows:

$$q_i t_{inj} = \pi R_{ci}^2 \phi (1 - S_{rw}), \tag{1.28}$$

Or, in terms of total injection rate:

$$Q_{inf} = A \sum_{i=1}^{N} L_i t_{Di}, \tag{1.29}$$

This equation is used to estimate the flow profile along the wellbore with $t_{Di}$ determined from FIG. 15. This method relates injection rate to the temperature in an exponential relationship.

Figure 16:
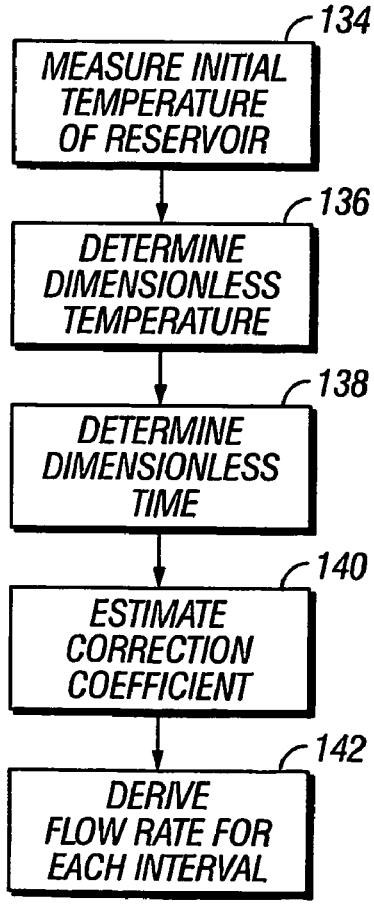
FIG. 16 is a flowchart generally representing a methodology for determining flow rates for a plurality of intervals along a deviated well.

Thus, a procedure for estimating the injection profile based on thermal data obtained during a shut-in period can be summarized as set forth in the flowchart of FIG. 16. First, the initial temperature of the reservoir, $T_r$, is obtained, as illustrated by block 134. The dimensionless temperature for each interval of grid system 132 is determined from the temperature log and the reservoir temperature: $T_d = (T_r - T_s)/(T_r - T_{inj})$, as illustrated by block 136. For each unit depth of grid system 132, the dimensionless time $t_D$ can be determined from the graph illustrated in FIG. 15, as set forth in block 138. The dimensionless time for each interval along wellbore 30 is used in the equation for estimating the correction coefficient A, as illustrated by block 140. The flow rate into the reservoir for this interval is: $A*t_{Di}$, as illustrated by block 142, and these flow rates can be combined to determine the overall injection flow profile.

Accordingly, models, such as those described above, can be used to enable the determination of injection flow profiles in deviated wells, such as horizontal wells. The use of temperature sensing systems, such as distributed temperature sensors, further enable the desired collection of thermal data utilized by the models in deriving accurate injection flow profiles.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of determining characteristics of an injection well, comprising:

obtaining an initial temperature profile along a deviated wellbore prior to injection;

measuring the temperature of an injection fluid prior to injection;

injecting the injection fluid into the deviated wellbore;

establishing a temperature profile; and determining a flow profile for the injection fluid based on a well model utilizing the initial temperature profile, the temperature of the injection fluid, and the temperature profile.

2. The method as recited in claim 1, wherein obtaining an initial temperature profile comprises obtaining the temperature profile with a distributed temperature sensor.

3. The method as recited in claim 1, wherein injecting the injection fluid comprises injecting water into the deviated wellbore.

4. The method recited in claim 1, wherein establishing a temperature profile comprises establishing a temperature profile over a time period with a distributed temperature sensing system.

5. The method as recited in claim 1, wherein establishing a temperature profile comprises establishing a temperature profile during an injection.

6. The method as recited in claim 1, wherein establishing a temperature profile comprises establishing the temperature profile during a shut-in period.

7. The method as recited in claim 1, wherein determining a flow profile comprises determining the flow profile along a substantial length of a generally horizontal portion of the deviated wellbore.

8. The method as recited in claim 1, wherein determining a flow profile comprises selecting a grid scheme and a grid size along the wellbore.

9. The method as recited in claim 1, wherein determining a flow profile comprises factoring a thermal conductivity of the reservoir into the well model.

10. The method as recited in claim 1, wherein determining a flow profile comprises factoring an injection rate into the well model.

11. The method as recited in claim 1, wherein determining a flow profile comprises factoring historical data into the well model.

12. The method as recited in claim 1, wherein determining a flow profile comprises factoring a permeability of the reservoir into the well model.

13. A method of determining characteristics of a well, comprising:

injecting a liquid into a generally horizontal wellbore of a well;

shutting the well in for a shut-in period; and determining a flow profile based on temperature profiles taken during the shut-in period and reservoir thermal conductivity data.

14. The method as recited in claim 13, wherein shutting the well in comprises shutting the well for one to two days.

15. The method as recited in claim 13, wherein the temperature profiles are obtained via a distributed temperature sensor.

16. The method as recited in claim 13, wherein shutting the well in comprises stopping injection of the liquid until a sufficient temperature contrast develops between the liquid and the wellbore.

17. The method as recited in claim 13, further comprising repeating injecting, shutting in and restarting injection of the well.

18. A method of determining a flow profile in a deviated well, comprising:

injecting a fluid into a deviated wellbore; and applying a multi-segment well model to measured well parameters for determining an injected flow profile for the liquid; and wherein applying a multi-segment well model further comprises incorporating a thermal conductivity of the reservoir into the multi-segment well model.

19. The method as recited in claim 18, wherein injecting a fluid comprises injecting water.

20. The method as recited in claim 18, wherein applying a multi-segment well model comprises applying the multi-segment well model to a temperature profile.

21. The method as recited in claim 18, wherein applying a multi-segment well model comprises applying the multi-segment well model to a temperature profile taken during an injection period.

22. The method as recited in claim 18, wherein applying a multi-segment well model comprises applying the multi-segment well model to a temperature profile taken during a shut-in period.

23. The method as recited in claim 20, wherein applying a multi-segment well model further comprises incorporating an injection rate into the multi-segment well model.

24. The method as recited in claim 20, wherein applying a multi-segment well model further comprises incorporating an injection time period into the multi-segment well model.

25. The method as recited in claim 20, wherein applying a multi-segment well model further comprises incorporating a permeability of the reservoir into the multi-segment well model.

26. A system, comprising:

a temperature sensor deployed in a deviated wellbore of an injection well to obtain temperature data along the wellbore; and a processor system able to receive the temperature data and to utilize the temperature data in deriving a flow profile of a fluid injected along the deviated wellbore, wherein the processor system is also able to receive and process reservoir thermal conductivity data in deriving the flow profile.

27. The system as recited in claim 26, wherein the temperature sensor comprises a distributed temperature sensor.

28. The system as recited in claim 26, wherein the processor system utilizes temperature data obtained during injection of the fluid.

29. The system as recited in claim 26, wherein the processor system utilizes temperature data obtained during a shut-in period.

30. The system as recited in claim 26, wherein the processor system utilizes a multi-segment well model.

31. The system as recited in claim 26, wherein the deviated wellbore is generally horizontal.

32. The system as recited in claim 26, wherein the processor system is also able to receive and process reservoir permeability data in deriving the flow profile.

* * * * *